United States Patent [19]

Shimizu

[11] Patent Number: 4,777,895

[45] Date of Patent: Oct. 18, 1988

[54] METHOD OF SEWING SHEET MATERIAL AND AN APPARATUS THEREFOR

[75] Inventor: Hiromitsu Shimizu, Osaka, Japan

[73] Assignee: Hirose Manufacturing Company, Limited, Osaka, Japan

[21] Appl. No.: 46,941

[22] Filed: May 7, 1987

[51] Int. Cl.[4] ..... D05B 97/00; D05B 27/00

[52] U.S. Cl. ..... 112/262.1; 112/270; 112/DIG. 2; 112/153; 112/303

[58] Field of Search ..... 112/262.1, 281, 280, 112/270, DIG. 2, 153, 303

[56] References Cited

U.S. PATENT DOCUMENTS

| | | | |
|---|---|---|---|
| 1,758,101 | 5/1930 | Bates | 112/281 |
| 2,316,648 | 4/1943 | Giglio | 112/281 |
| 2,376,216 | 5/1945 | Wertz | 112/281 |
| 2,400,741 | 5/1946 | Christensen et al. | 112/281 |
| 2,457,362 | 2/1948 | Giglio | 112/281 |
| 2,650,557 | 9/1953 | Hauser | 112/281 |
| 3,204,591 | 9/1965 | Pickett | 112/DIG. 2 |
| 3,252,437 | 5/1966 | Pickett | 112/DIG. 2 |
| 3,483,836 | 12/1968 | Meersand | 112/281 |
| 3,631,826 | 1/1972 | Morgan | 112/153 |
| 4,369,723 | 1/1983 | Griffith, Jr. et al. | 112/281 |
| 4,590,876 | 5/1986 | Mencke et al. | 112/DIG. 2 |

FOREIGN PATENT DOCUMENTS

| | | | |
|---|---|---|---|
| 1133225 | 7/1962 | Fed. Rep. of Germany | 112/281 |
| 2730866 | 1/1979 | Fed. Rep. of Germany | 112/281 |
| 252853 | 9/1969 | U.S.S.R. | 112/281 |

*Primary Examiner*—H. Hampton Hunter

*Attorney, Agent, or Firm*—Wenderoth, Lind & Ponack

[57] ABSTRACT

A method of sewing sheet material passing over a throat plate of a sewing machine by providing a nozzle member having a nozzle adjacent a sewing needle at an upstream side thereof with respect to a moving direction of the sheet material and impregnating the sheet with lubricating fluid by supplying the lubricating fluid from the nozzle such that the fluid contacts a surface of the sheet material facing the throat plate. Thereby, component yarns of the sheet are prevented from being severed when the needle pierces through the sheet material such that the severances are minimized.

20 Claims, 4 Drawing Sheets

METHOD OF SEWING SHEET MATERIAL AND AN APPARATUS THEREFOR

BACKGROUND OF THE INVENTION

1. Field of the Invention

This invention relates to a method of sewing sheet material and an apparatus therefor.

2. Description of the Prior Art

When a sewing operation is carried out employing conventional sewing techniques, so-called yarn severances often occur such that component yarns of the cloth being sewn are severed by a needle in the course of the up and down reciprocating movement of the needle. It is strongly desired that such yarn severance be prevented particularly where garments such as lingerie and blouses are being sewn.

SUMMARY OF THE INVENTION

The object of the invention is to provide a sewing method and an apparatus therefor which prevents yarn severances in sheet material such as cloth or the like being sewn.

In accomplishing the above object, a method of sheet sewing in accordance with the invention comprises the steps of; providing a nozzle member having a nozzle adjacent a sewing needle at an upstream side thereof in a moving direction of a sheet to be sewn; and impregnating the sheet with lubricating fluid by supplying the lubricating fluid from the nozzle.

In a preferred embodiment, the method comprises the step of; impregnating the sheet with the lubricating fluid also from a nozzle provided above the sheet.

In another preferred embodiment, the lubricating fluid is a liquid.

In still another preferred embodiment, the lubricating fluid is a vapor.

In accomplishing the above object, a sheet sewing apparatus in accordance with the invention comprises; flat plates on which a sheet to be sewn is placed, moving means for moving the sheet on the flat plates toward a predetermined moving direction, a sewing needle for sewing the sheet being moved on the flat plates by the moving means, a nozzle member having a nozzle in communication with an opening in an upper surface of the flat plates at the upstream side with respect to the sewing needle in the moving direction, and supplying means for supplying the lubricating fluid to the nozzle.

In a preferred embodiment, the nozzle member comprises, a chamber with which the nozzle communicates, a restriction hole formed coaxially with the nozzle and communicating with the chamber, and a supplying hole formed at a position offset from the restriction hole; and the supply means for supplying the lubricating fluid comprises, pumping means for pumping air into the restriction hole, and a vessel for storing the lubricating fluid provided in connection with the supplying hole.

In another preferred embodiment, the pumping means for pumping air comprises, a diaphragm for defining a pump chamber, a suction relief valve for leading air to the pump chamber, a discharge relief valve for leading air from the pump chamber to the restriction hole, and a driving means for reciprocatingly moving the diaphragm.

In still another preferred embodiment, the driving means comprises, a permanent magnet fixed to the diaphragm, coils for magnetically attracting and repulsing the permanent magnet, and an AC supply for energizing the coils.

According to the invention, lubricating liquid is supplied onto the sheet such as cloth or the like being sewn through a nozzle so that the sheet is impregnated with the lubricating fluid, the sheet being then sewn by the needle. The needle pierces through that portion of the sheet which is thus lubricated with the lubricating fluid, and thus (a) the sheet can have good flexibility or softness; (b) the coefficient of friction between the needle and the sheet is reduced; and (c) the needle is cooled down. Accordingly, the possibility of yarn severance by the needle is eliminated.

According to the invention, the sheet such as cloth or the like to be sewn is wetted by the lubricating fluid so that the sheet has good flexibility or softness given to it and so that the friction between the needle and the sheet is minimized. In addition, the needle is cooled down by the fluid. Thus, component yarns of the sheet are prevented from being severed when the needle pierces through the sheet and yarn severances are minimized.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1:
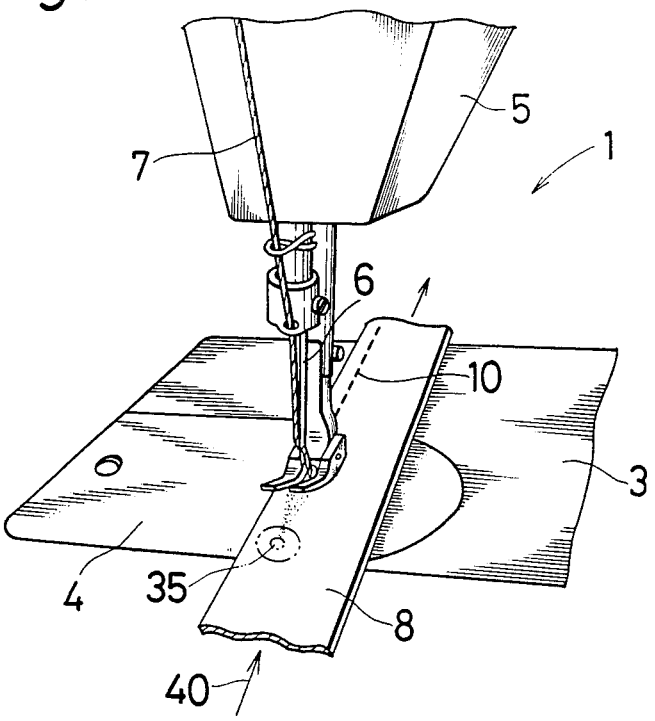
FIG. 1 is a partial perspective view showing one embodiment of the invention.

Referring now to the drawings, embodiments of the invention are described below.

Figure 2:
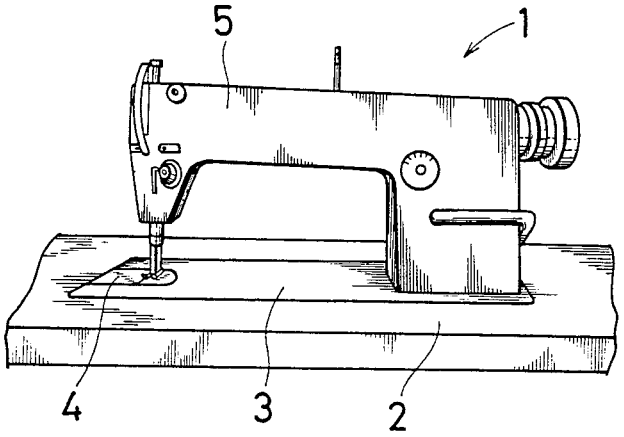
FIG. 2 is a perspective view showing the sewing machine in FIG. 1.

FIG. 1 is a partial view in perspective of a sewing machine 1 showing one embodiment of the invention, and FIG. 2 is a general view showing the sewing machine 1 in perspective. A bed 3 of the sewing machine 1 is disposed on a table 2. The bed 3 is provided with a throat plate 4. In a head portion 5 of the sewing machine 1 there is disposed a reciprocatable sewing needle 6 by which a needle thread 7 is carried. A moving means 39 (see FIG. 4 mentioned below) is in touch with an undersurface of a cloth 8 being sewn, and the cloth 8 is moved in the direction indicated by the arrow 40. Stitches 10 are formed in the cloth 8 as the cloth 8 is moved.

Figure 3:
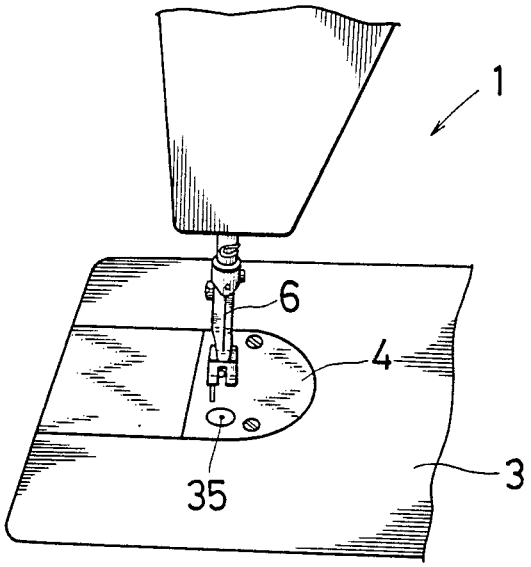
FIG. 3 is a partial perspective view of the sewing machine in which the cloth in FIG. 1 is omitted.

FIG. 3 is a perspective view of the sewing machine 1 in which the cloth 8 is not shown. According to the invention, a nozzle 35 for upwardly spraying a mist of water as a lubricating fluid is provided in the throat plate 4 at a location adjacent to and upstream of the needle 6.

Figure 4:
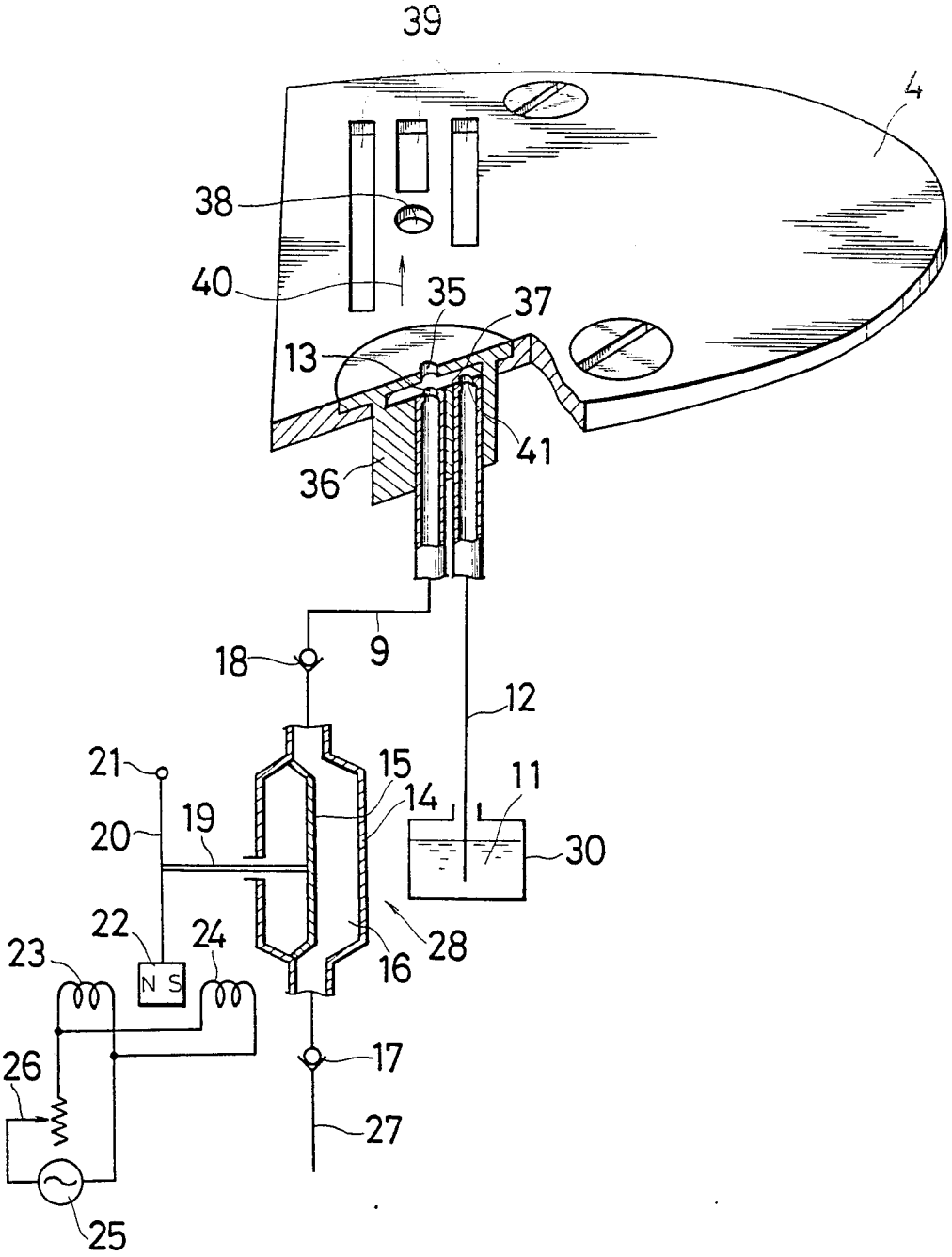
FIG. 4 is a schematic representation showing an arrangement associated with a nozzle.

FIG. 4 is a schematic view showing an arrangement associated with the nozzle 35. The nozzle 35 is formed in a top plate of a nozzle memeber 36. A restriction hole 13 which is formed coaxially so as to be axially aligned with the nozzle 35 has a diameter smaller than that of the nozzle 35, into which restriction hole 13, is pumped gas such as air from a pipeline or conduit 27 by a diaphragm pump 28 through a pipeline 9. Liquid such as water 11 in a vessel 30 is supplied by suction into a mixing chamber 37 between the nozzle 35 and the restriction hole 13 from a pipeline or conduit 12 through a supplying hole 41 which is coplanar with the restriction hole 13 and offset therefrom. A surface of liquid in the vessel 30 is exposed to atmospheric pressure by a suitable opening in the vessel. The air from the pipeline 9 allows water 11 to be sucked into the chamber 37 through the pipeline 12 by a Venturi action of the restriction hole 13 since the gas is compressed in the restriction hole and expanded in the mixing chamber 37, so that the water is sprayed upwardly in the form of a mist through the nozzle 35. The mist of water 11 is supplied onto the cloth 8 for lubrication. Stitches are formed as the needle 6 pierces through the portion of the cloth 8 which is moistened with water 11. A reference number shown by 38 is a needle hole through which the needle passes during the sewing operation.

The pump 28 has a diaphragm 15 provided in a pump body 14, the diaphragm defining a pump chamber 16. In the pump chamber 16 there is provided a suction relief valve 17 for flowing air from the pipeline 27 to the pump chamber 16 when the pump chamber 16 is expanded in size and a discharge relief valve 18 for discharging air from the pump chamber 16 to the pipeline 9 when the pump chamber 16 is reduced in size. A link 19 is connected to the diaphragm 15, the link 19 being pin-connected to a lever 20. The lever 20 is supported at one end by a pin 21 in position so that it is angularly displaceable about the pin 21. A permanent magnet fragment 22 is fixed to the other end of the lever 20. Coils 23, 24 are disposed correspondingly to the respective poles of the permanent magnet fragment 22. The coils 23, 24 are connected in parallel and are supplied with exciting current from an AC supply 25 through a current regulator 26. When the permanent magnet fragment 22 is attracted by the coil 23, the magnet 22 is in magnetic repulsion against the coil 24. Conversely, when the permanent magnet fragment 22 is attracted by the coil 24, the coil 23 is in magnetic repulsion against the magnet fragment 22. Thus, the permanent magnet fragment 22 reciprocatingly moves rightward and leftward in FIG. 4. Accordingly, the diaphragm 15 is reciprocatingly moved so that air from the pipeline 27 is sucked into the pump chamber 16 and the air in the pump chamber 16 is pumped into the nozzle 35 through the pipeline 9.

Figure 5:
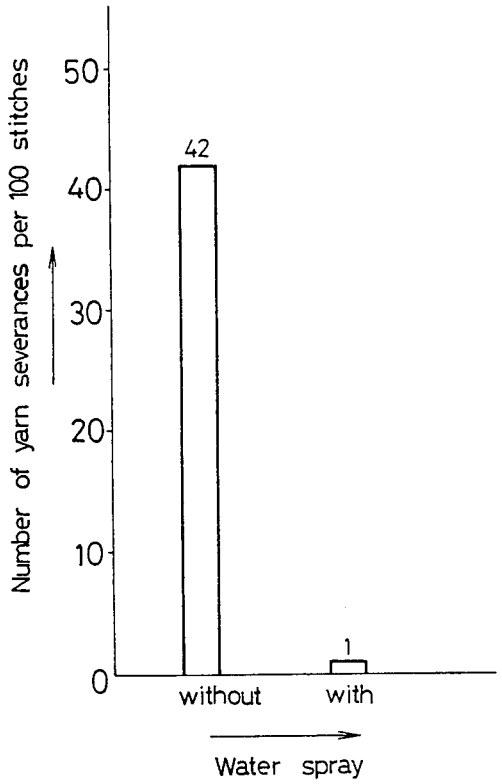
FIG. 5 is a graph showing a comparison between the invention and the prior art in the number of yarn severance occurrences per 100 stitches.

Experiments with the sewing machine of the invention will now be explained. The machine was run on a 4500 rpm basis. A needle 6 of DB×1#11 (in Japanese Industrial Standard) was used. For the cloth 8, a Tetoron (registered trademark) and cotton mixed woven broad cloth was used in two plies. With a cloth forwarding pitch of 2 mm, and a water spray of 4.3 cc/min, the cloth 8 was sewn up over a length of 80 cm. The number of yarn severance occurrences for 100 stitches formed prior to the end of this sewing operation was measured and the measurements are shown in FIG. 5. Normally there is a temperature rise at the needle 6 because of friction between the needle 6 and the cloth 8, before the end of a sewing operation. In such condition, yarn severances are likely to occur. According to the experiments with the invention, the number of yarn severances per 100 stitches was only one. In contrast to this, the number of yarn severances observed with a conventional sewing machine was 42. It is apparent from this comparison that the method and the apparatus of the invention helps reduce yarn severances remarkably.

For the lubricating fluid, water or alternatively silicone oil or other liquid may be used. Vapour such as steam or the like may also be used. In the foregoing embodiment, the nozzle 35 is provided in the throat plate 4. Alternatively, it may be provided in the bed 3 or at another location. For example, above the bed 3 and the throat plate 4, in which case the lubricating liquid may be supplied from above onto the cloth 8 for lubrication. A plurality of nozzles 35 may be provided so that the lubricating fluid is supplied not only when the cloth 8 is running straightforward in the direction 40, but also when it is run in the opposite direction so that such fluid supply is made constantly at the upstream side of the sewing position of the needle 6.

The method of this invention and the apparatus thereof can be practiced in conjunction with various types of sewing machines, such as a single needle lockstitch machine, a double row stitch machine, a zigzag chain stitch machine, an overlock machine, and the like.

In the case where the cloth 8 is of a thick gage, the arrangement of the invention may be modified so that lubricating liquid is supplied not only through the nozzle 35 provided below the cloth 8, but also from a nozzle provided above the cloth 8, whereby the thick cloth is sufficiently moistened before it is sewn up by the needle.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of sewing sheet material wherein the sheet material has one surface thereof supported on a throat plate of a sewing machine, the method comprising the steps of;

providing a nozzle member having a nozzle adjacent a sewing needle at an upstream side thereof with respect to a moving direction of a sheet material to be sewn with an outlet of the nozzle facing the surface of the sheet material facing the throat plate; and impregnating the sheet material with lubricating fluid by spraying the lubricating fluid from the nozzle onto the surface of the sheet material facing the throat plate.

2. A method of sewing sheet material as claimed in claim 1, wherein the method further comprises the step of;

impregnating the sheet material with the lubricating fluid from a nozzle provided above the sheet by spraying the lubricating fluid in contact with a surface of the sheet material opposite to the surface facing the throat plate.

3. A method of sewing sheet material as claimed in claim 1, wherein the lubricating fluid is liquid.

4. A method of sewing sheet material as claimed in claim 1, wherein the lubricating fluid is vapor.

5. A sheet sewing apparatus comprising;

a throat plate on which a sheet material to be sewn is placed, moving means for moving the sheet material on the throat plate toward a predetermined moving direction, a sewing needle for sewing the sheet material being moved on the throat plate by the moving means, means for spraying lubricating fluid onto a surface of the sheet material facing the throat plate, the lubricating fluid spraying means comprising a nozzle member having a nozzle with an outlet thereof in an upper surface of the throat plate at a position upstream of the sewing needle with respect to the moving direction of the sheet material, and supplying means for supplying the lubricating fluid to the nozzle.

6. A sheet sewing apparatus as claimed in claim 5, wherein the nozzle member comprises, a chamber in fluid communication with the nozzle, a restriction hole having a central axis thereof coincident with a central axis of the nozzle and in fluid communication with the chamber, and a supplying hole spaced from the restriction hole and in fluid communication with the chamber; and the supply means for supplying the lubricating fluid comprises, pumping means for pumping air into the restriction hole, and means for storing the lubricating fluid comprising a vessel in fluid communication with the supplying hole.

7. A sheet sewing apparatus as claimed in claim 6, wherein the pumping means for pumping air comprises, a pump chamber having a diaphragm therein for increasing and decreasing the volume of the pump chamber upon movement of the diaphragm, a suction relief valve in fluid communication with the pump chamber for passing air to the pump chamber, a discharge relief valve in fluid communication with the pump chamber for passing air from the pump chamber to the restriction hole, and a driving means for reciprocatingly moving the diaphragm.

8. A sheet sewing apparatus comprising;

a throat plate on which a sheet material to be sewn is placed, moving means for moving the sheet material on the throat plate toward a predetermined moving direction, a sewing needle for sewing the sheet material being moved on the throat plate by the moving means, means for spraying lubricating fluid onto a surface of the sheet material facing the throat plate comprising a nozzle member having a nozzle opened onto an upper surface of the throat plate at the upstream side with respect to the sewing needle in the moving direction, the nozzle member comprising a chamber with which the nozzle communicates, a restriction hole formed coaxially with the nozzle and communicating with the chamber, and a supplying hole formed at a shifted position from the restriction hole, and supplying means for supplying the lubricating fluid to the nozzle comprising pumping means for pumping air into the restriction hole, the pumping means comprising a diaphragm for defining a pump chamber, a suction relief valve for leading air to the pump chamber, a discharge relief valve for leading air from the pump chamber to the restriction hole, and a driving means for reciprocatingly moving the diaphragm, the driving means comprising a permanent magnet operatively fixed to the diaphragm, coils for magnetically attracting and repulsing the permanent magnet, and an AC supply for energizing the coils, and the supplying means further comprising a vessel for storing the lubricating fluid provided in connection with the supplying hole.

9. A sheet sewing apparatus comprising:

a throat plate on which a sheet material to be sewn is placed;

means for spraying lubricating fluid on a surface of the sheet material facing the throat plate, the lubricating fluid supplying means including a nozzle member having a nozzle with an outlet thereof in a surface of the throat plate facing the sheet material at a position upstream of a reciprocatable sewing needle with respect to movement of the sheet material when being sewn by the needle; and supplying means for supplying the lubricating fluid to the nozzle.

10. The sheet sewing apparatus of claim 9, wherein the means for spraying lubricating fluid includes a mixing chamber in fluid communication with the outlet of the nozzle and the supplying means includes a gas supply in fluid communication with the mixing chamber and a liquid supply in fluid communication with the mixing chamber.

11. The sheet sewing apparatus of claim 10, wherein the gas supply includes a gas conduit and a restriction hole connecting the gas conduit to the mixing chamber, the restriction hole being smaller in size than a portion of the gas conduit adjacent to the restriction hole whereby gas supplied through the gas conduit is compressed in the restriction hole and expanded in the mixing chamber to thereby supply a mist of gas and liquid to the nozzle.

12. The sheet sewing apparatus of claim 11, wherein the liquid supply includes a liquid conduit and a supplying hole connecting the liquid conduit to the mixing chamber, the supplying hole being coplanar with the restriction hole and offset therefrom.

13. The sheet sewing apparatus of claim 12, wherein the liquid supply includes a vessel for containing the liquid, the vessel including means for exposing an upper surface of liquid in the vessel to atmospheric pressure.

14. The sheet sewing apparatus of claim 11, wherein the restriction hole is axially aligned with the nozzle.

15. The sheet sewing apparatus of claim 10, wherein the gas supply includes means for pumping gas through the gas conduit, the pumping means including a pump chamber and a diaphragm means comprising a diaphragm for increasing and decreasing the volume of the pump chamber, the gas supply further including valve means in the gas conduit for providing one-way flow of gas through the gas conduit into the pump chamber and one-way flow of gas through the gas conduit from the pump chamber to the mixing chamber.

16. The sheet sewing apparatus of claim 15, wherein the valve means comprises a suction relief valve and a discharge relief valve, the pump chamber being disposed between the suction relief valve and the discharge relief valve, and the discharge relief valve being between the pump chamber and the mixing chamber.

17. The sheet sewing apparatus of claim 15, wherein the pumping means includes means for reciprocating the diaphragm in the pump chamber, the reciprocating means including a link connected to the diaphragm and extending outwardly from the pump chamber, and means for driving the link towards and away from the pump chamber.

18. The sheet sewing apparatus of claim 17, wherein the link driving means comprises a lever pivotally connected at one end thereof to a support and connected to the link at a position spaced from the one end to effect movement of the link due to pivoting of the lever, the lever having a permanent magnet affixed thereto at a position spaced from the one end, the link driving means further comprising first and second spaced-apart coil means for attracting and repulsing the magnet, the first and second coil means being located on opposite sides of the magnet, respectively, and means for energizing the first and second coil means to drive the link towards and away from the pump chamber.

19. The sheet sewing apparatus of claim 18, wherein the energizing means comprises a source of alternating current.

20. The sheet sewing apparatus of claim 13, wherein the vessel is located at a position below the throat plate, the gas comprises air and the liquid comprises water.

* * * * *